US008763804B2

(12) United States Patent
Ledesma

(10) Patent No.: US 8,763,804 B2
(45) Date of Patent: Jul. 1, 2014

(54) PROTECTIVE CASE FOR PORTABLE ELECTRONIC APPARATUS

(71) Applicant: Modelabs Group, Paris (FR)

(72) Inventor: Cristina Ledesma, Paris (FR)

(73) Assignee: Modelabs Group, Paris (FR)

( * ) Notice: Subject to any disclaimer, the term of this patent is extended or adjusted under 35 U.S.C. 154(b) by 0 days.

(21) Appl. No.: 13/835,979

(22) Filed: Mar. 15, 2013

(65) Prior Publication Data

US 2013/0240382 A1 Sep. 19, 2013

(30) Foreign Application Priority Data

Mar. 15, 2012 (FR) ..... 12/00798

(51) Int. Cl.
*B65D 85/00* (2006.01)

(52) U.S. Cl.
USPC ..... 206/320; 206/45.23; 206/45.24

(58) Field of Classification Search
USPC ..... 206/320, 45.24, 45.23, 45.2, 759, 762
See application file for complete search history.

(56) References Cited

U.S. PATENT DOCUMENTS

| | | | | |
|---|---|---|---|---|
| 4,259,568 | A | 3/1981 | Dynesen | |
| 5,887,723 | A * | 3/1999 | Myles et al. | 206/760 |
| 8,235,208 | B2 * | 8/2012 | Sirichai et al. | 206/320 |
| 8,281,924 | B2 * | 10/2012 | Westrup | 206/320 |
| 8,282,065 | B1 * | 10/2012 | Stone | 248/454 |
| 8,312,991 | B2 * | 11/2012 | Diebel et al. | 206/45.24 |
| 8,434,601 | B2 * | 5/2013 | Hou et al. | 190/1 |
| 8,474,609 | B1 * | 7/2013 | Hong et al. | 206/45.2 |
| 2004/0240164 | A1 * | 12/2004 | Lee | 361/683 |
| 2008/0302687 | A1 | 12/2008 | Sirichai et al. | |
| 2011/0290687 | A1 * | 12/2011 | Han | 206/320 |
| 2011/0297564 | A1 * | 12/2011 | Kim et al. | 206/320 |
| 2012/0037285 | A1 | 2/2012 | Diebel et al. | |
| 2012/0043234 | A1 * | 2/2012 | Westrup | 206/320 |
| 2012/0153116 | A1 * | 6/2012 | Harrison | 248/460 |
| 2013/0048514 | A1 * | 2/2013 | Corcoran et al. | 206/45.23 |
| 2013/0075280 | A1 * | 3/2013 | Besner | 206/45.23 |
| 2013/0126365 | A1 * | 5/2013 | Hung | 206/45.24 |
| 2013/0134061 | A1 * | 5/2013 | Wu et al. | 206/320 |
| 2013/0175200 | A1 * | 7/2013 | Poon et al. | 206/759 |

FOREIGN PATENT DOCUMENTS

DE 202010008665 U 12/2010

OTHER PUBLICATIONS

European Search Report dated Jul. 12, 2013 for European Application No. 13157011.1, 7 pages.

* cited by examiner

*Primary Examiner* — Steven A. Reynolds
(74) *Attorney, Agent, or Firm* — Patterson Thuente Pedersen, P.A.

(57) ABSTRACT

A protective case which offers an efficient protective position without hindering an easy positioning of the apparatus in a slanted position. The case includes a back face, a front face, an edge connecting the back face with the front face and forming a first articulation between the front face and the back face in order to make it possible for the case to move between and from a first open position where the front face is coplanar with the back face to a second protective position where the front face is folded over the back face.

20 Claims, 3 Drawing Sheets

PROTECTIVE CASE FOR PORTABLE ELECTRONIC APPARATUS

RELATED APPLICATION

The present application claims priority to French Application No. 12/00798 filed Mar. 15, 2012, which is incorporated herein in its entirety by reference.

TECHNICAL FIELD

The present invention generally relates to a case for the protection of a portable electronic apparatus, such as for example a telephone.

BACKGROUND OF THE INVENTION

It has been known from the prior art cases for protecting portable electronic apparatuses. For example, a well known protective case is that which comprises a front face and a back face articulated around an edge, with engaged elastic means that maintain the front face folded over the back face when the case is in protective position of the electronic apparatus, itself fitted between the two sides and fastened to the back face. On the other hand, this system particularly has the drawback of not offering other possibilities than having a protective position as described above and an open position, where the elastic means are disengaged, the front face being coplanar with the back face. In the latter position, the apparatus is thus accessible for use. However, in the case where the user is not using the apparatus but wishes to have it in view, he/she should place it on an additional support for it to be slanted with respect to the horizontal in order to have good visibility or a good viewing angle of the apparatus. The abovementioned case thus becomes a nuisance for positioning the apparatus in this slanted position as the front face is bulky.

Finally, U.S. Patent Application Publication No. 2012/0037285 A1 describes a case for a portable electronic apparatus.

SUMMARY OF THE INVENTION

Embodiments of the present invention address many of the drawbacks of the prior art mentioned above and in particular. First, embodiments are directed to a protective case which offers an efficient protective position without hindering an easy positioning of the apparatus in a slanted position. For example, the case, according to embodiments, rapidly and/or readily provide an angled, slanted or otherwise alternative view of the electronic apparatus to a user.

For this purpose, embodiments are directed to a case for protecting a portable electronic apparatus, the case including a back face, a front face, an edge connecting the back face with the front face and forming a first articulation between the front face and the back face in order to make it possible for the case to move between and from a first open position where the front face is coplanar with the back face to a second protective position where the front face is folded over the back face.

The case also can comprise fixing means or a fixing member(s) fitted to fix the portable electronic apparatus on the back face such that it be between the back face and the front face when the case is in protective position; elastic means or member(s) fitted to maintain the front face folded over the back face when the case is in protective position.

Further, the back face can be formed in first and second portions connected by a second articulation, the second portion being fitted between the second articulation and the edge.

The fixing means or member(s) are fitted on the first portion of the back face. The first portion of the back face and the fixing means or member(s) can swivel backwards around the second articulation such as to move away from the front face, in order to bring the case into a third position called a standing position. Finally, the elastic means or member(s) can be fitted to pull the second portion of the back face towards the front face in order to maintain the case in standing position.

The case according to embodiments offers the possibility to easily position the apparatus in a third standing position, without the front face hindering this positioning thanks to the second articulation. Moreover, the maintaining of this third position is ensured by the elastic means or member(s) which pull the second portion towards the front face. In other words, the case according to the invention in standing position can be handled while remaining in this standing position.

In an embodiment, the fixing means or member(s) comprise a shell fastened to the first portion of the back face. This embodiment offers an efficient positioning and protection of the electronic apparatus and facilitates the kinematic positioning by giving additional resistance to the first portion of the back face.

In an embodiment, the front face comprises a friction resistant inner lining. This implementation offers increased durability.

In a particular embodiment, the front face comprises a friction insert on its inner portion. The insert can thus be chosen to be a resistant material which prevents or inhibits the inner lining from being subjected to repeated contact during the positioning in standing position.

In an embodiment, the front face comprises an abutment portion fitted to block the first portion of the back face when the case is in standing position. The standing position is reliable and the abutment portion prevents or inhibits any unexpected sliding of the first portion of the back face onto the front face.

In an embodiment, the abutment portion is an insert fitted on the inner side of the front face. This insert avoids having to shape the entire front face.

In a particular embodiment, the elastic means or member(s) are fastened to the front face and surround the second portion of the back face when the case is in protective position. The maintaining in folded position is efficient and the user can easily disengage the elastic means or member(s).

In an embodiment, the back face comprises an opening facing a photographic apparatus lens of the electronic apparatus, and the elastic means or member(s) are fitted outside the opening. The use of the photographic apparatus is not compromised even when the elastic means or member(s) surround the front face.

As an alternative to this embodiment, the elastic means or member(s) are fastened to the second portion of the back face and surround the front face when it is in protective position.

In a particular embodiment, the back face comprises an opening facing a photographic apparatus lens of the electronic apparatus, and the elastic means or member(s) are fitted outside the opening.

BRIEF DESCRIPTION OF THE DRAWINGS

Other characteristics and advantages of the present invention will become more apparent upon reading the following detailed description of an embodiment of the invention given by way of non limitative example and illustrated by the accompanying drawings, in which.

DETAILED DESCRIPTION OF THE DRAWINGS

Figure 1:
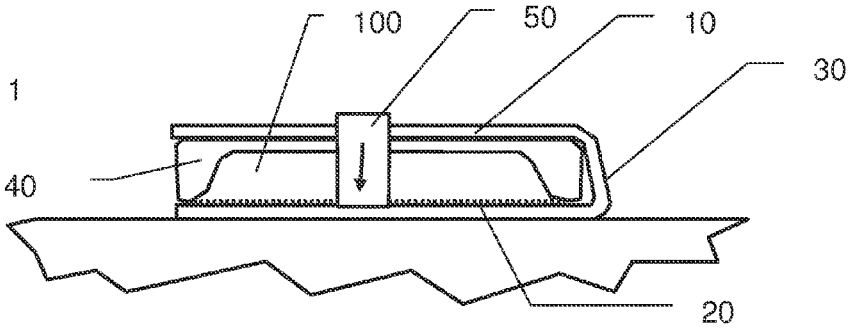
FIG. 1 represents a case according to an embodiment of the present invention in a protective position.

FIG. 1 represents a case according to embodiment in a protective position. An electronic apparatus 100 is fixed to a back face 10 by fixing means or member(s) 40 which comprises, for example, a shell structure. A front face 20 is connected to the back face 10 by an edge 30 which forms a first articulation between the faces 10, 20. Elastic means or member(s) 50 are fixed to the front face 20 and surround the back face 10 such as to maintain the front face 20 folded over the back face 10 by exerting a force represented by the arrow.

Figure 2:
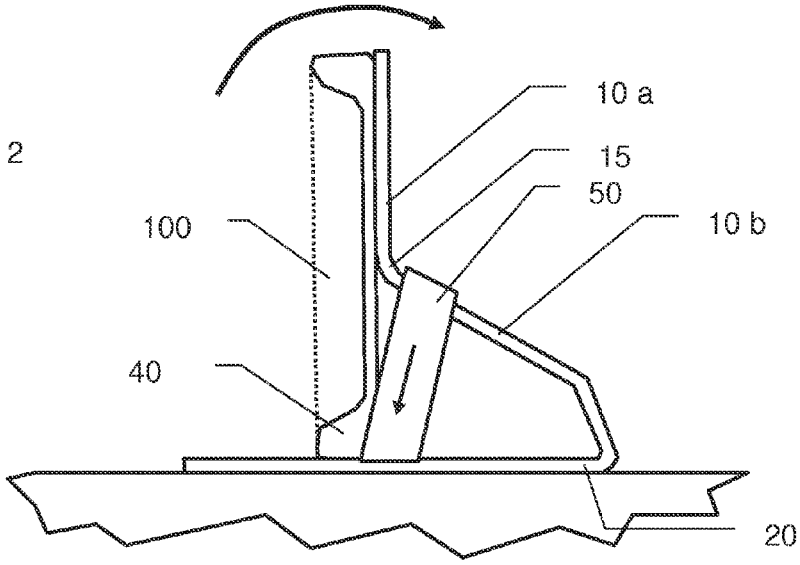
FIG. 2 represents the case of FIG. 1 in an intermediate position during its shifting from the protective position to a standing position.

FIG. 2 represents the case of FIG. 1 in an intermediate position, during its positioning in or shifting to a standing position. To this end, a first portion 10*a* of the back face 10 is swiveled around a second articulation 15 as indicated by the arrow, thus, causing it to move away from the front face 20. The elastic means or member(s) 50 pulls a second portion 10*b* from the back face towards the front face 20 forcing the fixing means 40 to be in contact with the inner portion of the front face 20. In the shown intermediary position, the electronic apparatus 100 is perpendicular to the front face 20.

Figure 3:
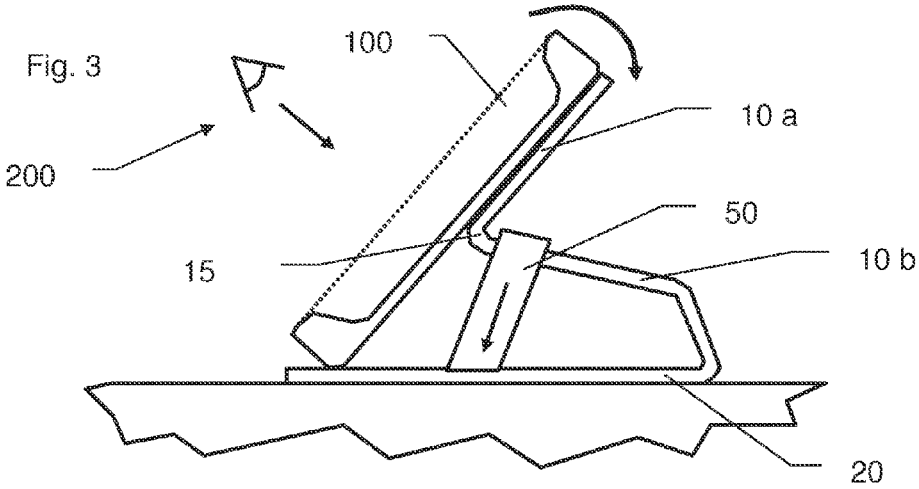
FIG. 3 represents the case of FIG. 1 in the standing position.

FIG. 3 represents the case of FIG. 1 in a standing position. The first portion 10*a* of the back face has finished pivoting around the second articulation 15 such that the electronic apparatus 100 is in a slanted position with respect to the front face 20 and a user 200 can easily or readily look at the electronic apparatus 100. The second portion 10*b* of the back face is pulled by the elastic means or member(s) 50 towards the front face 20 such that the standing position is ensured, even though the user 200 handles the case by the edge or only by the front face.

Figure 4:
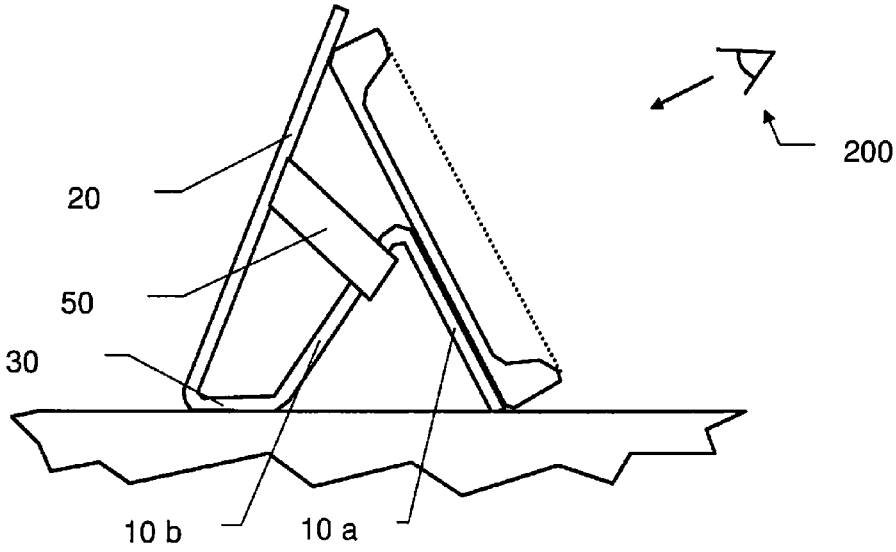
FIG. 4 represents the case in the standing position of FIG. 3, but in another orientation.

FIG. 4 represents the case in the standing position of FIG. 3, but in another orientation. In fact, the case rests on its support by means of the edge 30 and the first portion 10*a* of the back face connected to the edge by the second portion 10*b*. Since the elastic means or member(s) 50 pull the second portion 10*b* towards the front face 20, the standing position of the case is ensured, and thus, even if the user turns the case over.

Figure 5:
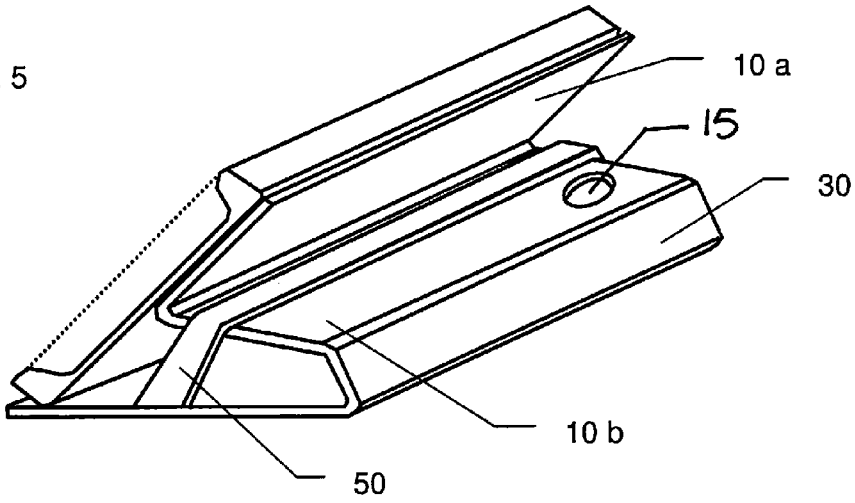
FIG. 5 represents a perspective view of the case in FIG. 3.

FIG. 5 represents a perspective of the case of FIG. 3, which makes it possible to orient the electronic apparatus 100 with respect to the support upon which the case rests, such as a landscape orientation, in order to offer a better or different view of the electronic apparatus 100. The back face 10 includes an opening 15 positioned proximate or facing a photographic apparatus lens of the electronic apparatus. The elastic means or member(s) 50 are fitted outside the opening 15 so that use of the photographic apparatus is not compromised.

Figure 6:
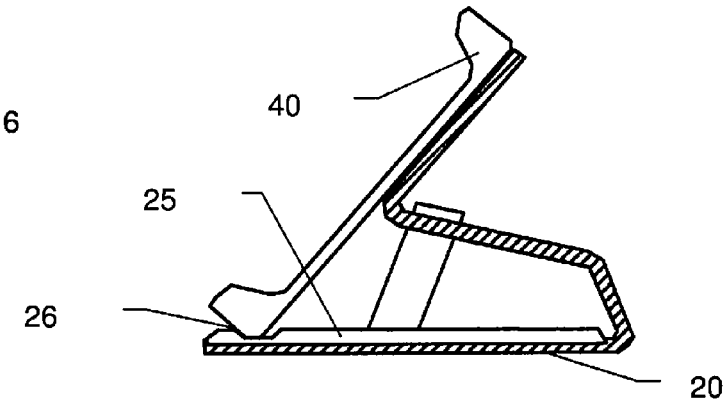
FIG. 6 represents a cross-section of the case in FIG. 3.

FIG. 6 represents a cross-section of the case of FIG. 3. In order to limit friction on the inner portion of the front face 20, an insert 25 is fitted in the front face and locally surpasses the inner surface of the front face 20. Thus, during the positioning into standing position, the shell 40 slides on the insert 25. The insert 25 can be made of a material which reduces friction such that the shell 40 freely slides on the insert 25 during the positioning into standing position. Furthermore, an abutment portion 26 can be implanted in the insert 25 in order to block the shell 40 in standing position to stabilize the holding in position of the case in the standing position.

Figure 7:
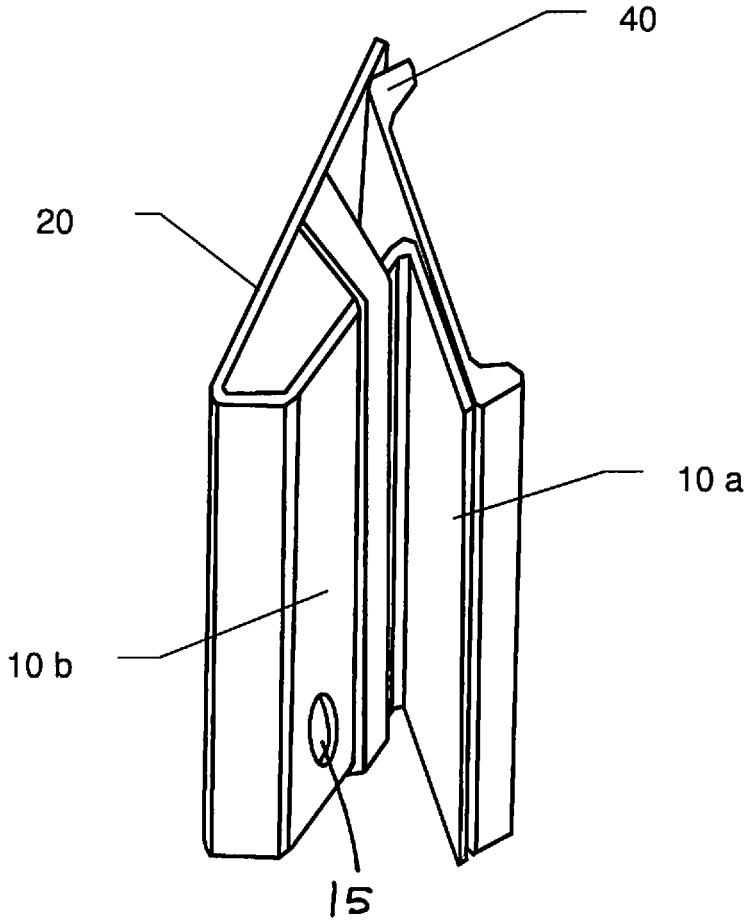
FIG. 7 represents the case in the standing position of FIG. 3, but in a vertical orientation.

FIG. 7 represents the case in standing position of FIG.3, but in a vertical or portrait orientation. In fact, the elastic means or member(s) which pull the second portion 10*b* towards the front face 20 make it possible to maintain the case according to embodiments of the present invention in the standing position and the user can place the case vertically on a support. Opening 15 is positioned proximate or facing the photographic apparatus lens of the electronic apparatus.

It will be understood that various modifications and/or improvements obvious for the skilled person may be brought to the different embodiments of the invention described in the present description without departing from the scope of the invention defined by the accompanying claims.

The invention claimed is:

1. A case for protecting a portable electronic apparatus, the case comprising:

a back face;

a front face;

an edge connecting the back face with the front face and forming a first articulation between the front face and the back face, wherein the case is shiftable between a first open position where the front face is coplanar with the back face, and a second protective position where the front face is folded over the back face;

fixing means configured to attach the portable electronic apparatus on the back face such that the portable electronic apparatus is positioned between the back face and the front face when the case is in the protective position; and elastic means positioned to maintain the front face folded over the back face when the case is in the protective position, wherein the back face includes a first and a second portion connected by a second articulation, the second portion being positioned between the second articulation and the edge, wherein the fixing means is fitted on the first portion of the back face, wherein the first portion of the back face and the fixing means is adapted to swivel backwards around the second articulation such as to move away from the front face, to shift the case into a third position called a standing position, wherein the elastic means are positioned to pull the second portion toward the front face in order to maintain the case in the standing position.

2. The case according to claim 1, wherein the fixing means comprise a shell fastened to the first portion of the back face.

3. The case according to claim 1, wherein the front face comprises a friction resistant inner lining.

4. The case according to claim 1, wherein the front face comprises a friction insert on an inner portion.

5. The case according to claim 1, wherein the front face comprises an abutment portion positioned to block the first portion of the back face when the case is in the standing position.

6. The case according to claim 5, wherein the abutment portion is an insert fitted on the inner side of the front face.

7. The case according to claim 1, wherein the elastic means are fastened to the front face and surround the second portion of the back face when the case is in the protective position.

8. The case according to claim 7, wherein the back face comprises a structure defining an opening positioned proximate a photographic apparatus lens of the electronic apparatus, and wherein the elastic means are fitted outside the opening so as not to occlude the opening.

9. The case according to claim 1, wherein the elastic means are fastened to the second portion of the back face and surround the front face when the case is in the protective position.

10. The case according to claim 9, wherein the back face comprises a structure defining an opening positioned proximate a photographic apparatus lens of the electronic apparatus, and wherein the elastic means are fitted outside the opening so as not to occlude the opening.

11. A case for protecting a portable electronic apparatus, the case comprising:

a back face;

a front face;

an edge connecting the back face with the front face and forming a first articulation between the front face and the back face, wherein the case is shiftable between a first open position where the front face is coplanar with the back face, and a second protective position where the front face is folded over the back face;

a fixing member configured to releaseably maintain the portable electronic apparatus on the back face such that the portable electronic apparatus is positioned between the back face and the front face when the case is in the protective position; and an elastic member adapted to maintain the front face folded over the back face when the case is in the protective position, wherein the back face includes a first and a second portion connected by a second articulation, the second portion being positioned between the second articulation and the edge, wherein the fixing member is fitted on the first portion of the back face, wherein the first portion of the back face and the fixing member is adapted to rotate about the second articulation such as to move away from the front face, to shift the case into a third position called a standing position, wherein the elastic member is adapted to pull the second portion toward the front face in order to maintain the case in the standing position.

12. The case according to claim 11, wherein the fixing member comprises a shell fastened to the first portion of the back face.

13. The case according to claim 11, wherein the front face comprises a friction resistant inner lining.

14. The case according to claim 11, wherein the front face comprises a friction insert on an inner portion.

15. The case according to claim 11, wherein the front face comprises an abutment portion positioned to block the first portion of the back face when the case is in the standing position.

16. The case according to claim 15, wherein the abutment portion is an insert fitted on the inner side of the front face.

17. The case according to claim 11, wherein the elastic member is fastened to the front face and surrounds the second portion of the back face when the case is in the protective position.

18. The case according to claim 17, wherein the back face comprises a structure defining an opening positioned proximate a photographic apparatus lens of the electronic apparatus, and wherein the elastic member is fitted outside the opening so as not to occlude the opening.

19. The case according to claim 11, wherein the elastic member is fastened to the second portion of the back face and surrounds the front face when the case is in the protective position.

20. The case according to claim 19, wherein the back face comprises a structure defining an opening positioned proximate a photographic apparatus lens of the electronic apparatus, and wherein the elastic member is fitted outside the opening so as not to occlude the opening.

* * * * *